US010206551B2

(12) United States Patent
Watson et al.

(10) Patent No.: US 10,206,551 B2
(45) Date of Patent: Feb. 19, 2019

(54) MOTOR DETECTION METHODOLOGY AND SYSTEM

(71) Applicant: General Electric Company, Schenectady, NY (US)

(72) Inventors: Eric K. Watson, Crestwood, KY (US); Lijie Hao, Vernon Hills, IL (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 286 days.

(21) Appl. No.: 15/062,538

(22) Filed: Mar. 7, 2016

(65) Prior Publication Data

US 2017/0251899 A1 Sep. 7, 2017

(51) Int. Cl.
*A47L 15/00* (2006.01)

(52) U.S. Cl.
CPC ..... *A47L 15/0018* (2013.01)

(58) Field of Classification Search
CPC ..... A47L 15/0018
See application file for complete search history.

(56) References Cited

FOREIGN PATENT DOCUMENTS

DE 3907432 A1 9/1990
WO WO2014113211 A1 7/2014

*Primary Examiner* — Jason Y Ko
(74) *Attorney, Agent, or Firm* — Dority & Manning, P.A.

(57) ABSTRACT

Systems and methods for identifying relay contact position within an appliance. In one embodiment, an appliance includes a first motor, a second motor, and a relay. The relay can be configured to be adjusted between at least a first position associated with a first circuit of the first motor and a second position associated with a second circuit of the second motor. The appliance can also include one or more control device(s) configured to identify the position of the relay within the appliance. For instance, the control device(s) can provide a test signal to the relay and detect an output signal that is based at least in part on the input signal. The output signal can be associated with the second circuit. The control device(s) can determine whether the relay is in the first position or the second position based at least in part on the output signal.

9 Claims, 5 Drawing Sheets

MOTOR DETECTION METHODOLOGY AND SYSTEM

FIELD OF THE INVENTION

The present disclosure relates generally to managing the power supplied an appliance and more particularly to identifying the position of a relay within an appliance to determine the amount of power to be supplied to a motor of the appliance.

BACKGROUND OF THE INVENTION

Modern washing appliances (e.g., dishwashers) typically include a wash pump assembly and a drain pump assembly. The wash pump assembly can be configured to circulate and/or re-circulate liquid that is used to wash the contents (e.g., dishes) of the washing appliance. The drain pump assembly can be configured to remove liquid (e.g., dirty liquid) from the washing appliance after use. Typically, the power required to run the wash pump assembly can be higher than the power required to run the drain pump assembly. Thus, to avoid damaging the appliance and to meet safety standards, it can be important to identify which assembly is connected to a power source before applying such power.

BRIEF DESCRIPTION OF THE INVENTION

Aspects and advantages of the present disclosure will be set forth in part in the following description, or may be obvious from the description, or may be learned through practice of the present disclosure.

One example aspect of the present disclosure is directed to an appliance. The appliance can include a first motor, a second motor, and a relay configured to be adjusted between at least a first position associated with a first circuit of the first motor and a second position associated with a second circuit of the second motor. The appliance can further include one or more control devices configured to identify the position of the relay within the appliance by executing computer-readable instructions stored in one or more memory devices that when executed by the one or more control devices cause the one or more control devices to perform operations. The operations can include providing a test signal to the relay and detecting an output signal that is based, at least in part, on the input signal. The output signal can be associated with the second circuit. The operations can further include determining whether the relay is in the first position or the second position based at least in part on the output signal.

Another example aspect of the present disclosure is directed to a method for identifying relay contact position within an appliance. The method can include providing, by one or more control devices, a test signal to a relay that is adjustable between a plurality of positions. The plurality of positions comprises a first position associated with a first circuit of a first motor and a second position associated with a second circuit of a second motor. The method can further include detecting, by the one or more control devices, an output signal that is based at least in part on the test signal. The method can include sampling, by the one or more control devices, the output signal at periodic intervals to determine a number of analog to digital counts. The method can include determining, by the one or more control devices, whether the relay is in the first position or the second position based at least in part on the number of analog to digital counts.

Yet another example aspect of the present disclosure is directed to a control device for identifying relay contact position. The control device can include one or more processors and one or more memory devices. The one or more memory devices can store instructions that when executed by the one or more processors cause the one or more processors to perform operations. The operations can include providing a test signal to a relay of an appliance. The relay can be configured to be adjusted between at least a first position associated with a first motor and a second position associated with a second motor. The operations can further include detecting an output signal associated with a second circuit associated with the second motor. The output signal can be based at least in part on the test signal. The operations can include determining the position of the relay based at least in part on the output signal.

Variations and modifications can be made to these example embodiments of the present disclosure.

These and other features, aspects and advantages of the present disclosure will become better understood with reference to the following description and appended claims. The accompanying drawings, which are incorporated in and constitute a part of this specification, illustrate embodiments of the invention and, together with the description, serve to explain the principles of the present disclosure.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION OF THE INVENTION

Figure 1:
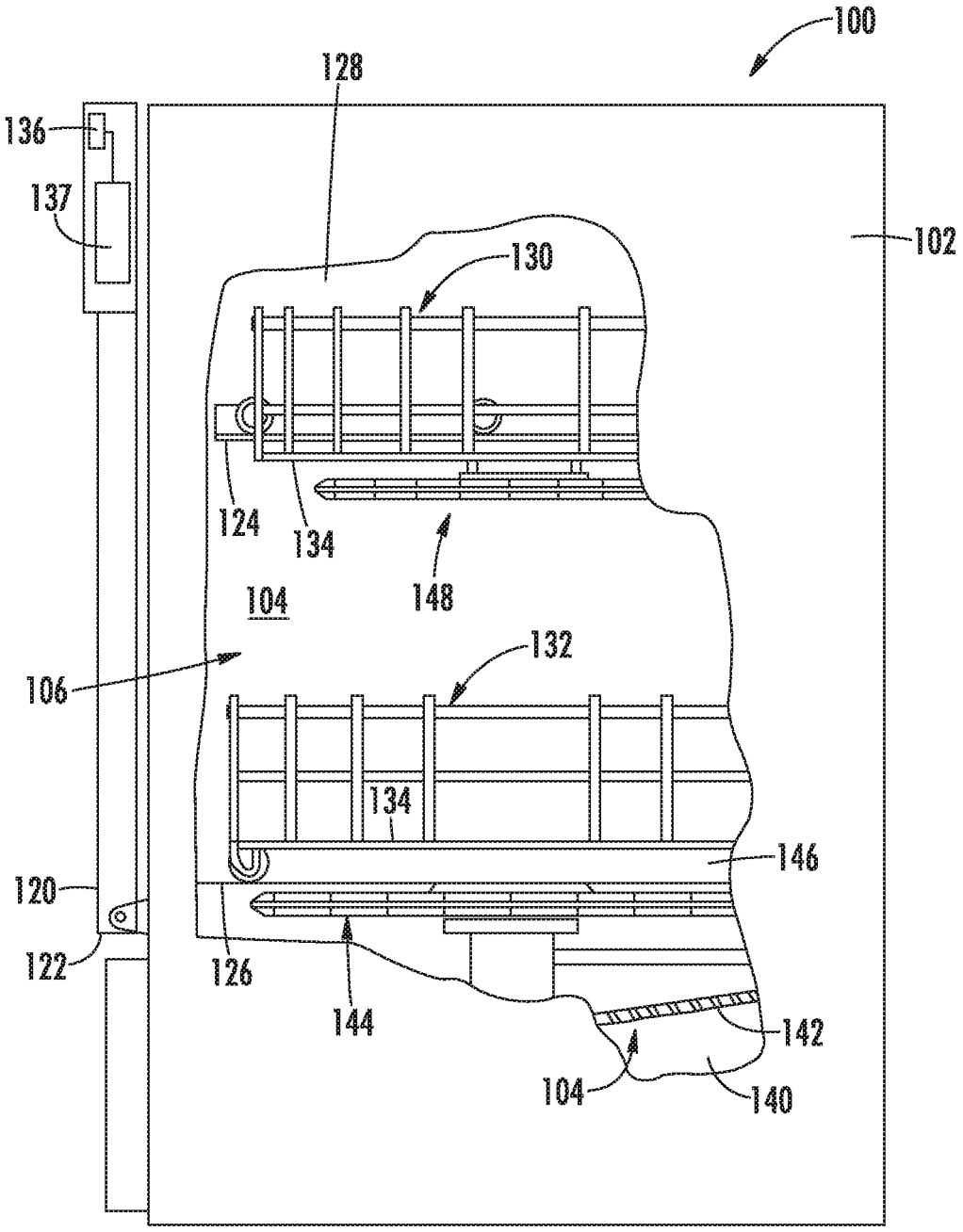
FIG. 1 depicts a side partial cut-away view of an appliance according to example embodiments of the present disclosure.

Reference now will be made in detail to embodiments of the present disclosure, one or more examples of which are illustrated in the drawings. Each example is provided by way of explanation of the present disclosure, not limitation of the present disclosure. In fact, it will be apparent to those skilled in the art that various modifications and variations can be made in the present disclosure without departing from the scope or spirit of the present disclosure. For instance, features illustrated or described as part of one embodiment can be used with another embodiment to yield a still further embodiment. Thus, it is intended that the present disclosure covers such modifications and variations as come within the scope of the appended claims and their equivalents.

Example aspects of the present disclosure are directed to systems and methods for identifying relay contact position within an appliance to help determine the amount of power to be supplied to a motor of an appliance. For instance, an appliance (e.g., a washing appliance) can include a wash motor associated with a wash pump assembly, a drain motor associated with a drain pump assembly, and a relay that is adjustable between a first position and a second position. When the relay is in the first position, at least the wash motor can be configured receive power. When the relay is in the second position, the drain motor can be configured to receive power. The appliance can include one or more control device(s) that can determine the position of the relay, to help determine the amount of power to supply to the wash and/or drain motors. For example, the control device(s) can provide a test signal to the relay such that it can be applied to the electrical components associated with the wash motor and/or the drain motor. The control device(s) can receive an output signal and determine the position of the relay based, at least in part, on the characteristics of the output signal. When the relay is in the second position, the control device(s) can provide a reduced amount of power to the drain motor (e.g., to avoid overheating the drain pump assembly). However, when the relay is in the first position, the control device(s) can provide a greater amount of power to the wash motor (e.g., enough power to run the wash pump assembly).

More particularly, the control device(s) of the appliance can provide a test signal to the relay. The relay can be adjustable between a plurality of positions, including a first position associated with a first circuit of a first motor (e.g., associated with the wash pump assembly) and a second position associated with a second circuit of a second motor (e.g., associated with the drain pump assembly). The test signal can include one or more pulses and a test voltage (e.g., 170V).

The electrical path of the test signal can depend on the position of the relay. For example, when the relay is in the first position the test signal can be applied to the electrical components of the first circuit (associated with the first motor) and the electrical components of the second circuit (associated with the second motor). However, when the relay is in the second position the test signal can be applied only to the electrical components of the second circuit (associated with the second motor).

The control device(s) can detect an output signal that is based, at least in part, on the test signal. Given the different electrical paths of the test signal, the output signal produced when the relay is in the first position can be different than the output signal produced when the relay is in the second position. For instance, in one example implementation, the output signal associated with the first position can be a sinusoidal wave with a lower voltage (e.g., 0.2V) and the output signal associated with the second position can be a square wave with a higher voltage (e.g., 3.0V).

The control device(s) can determine whether the relay is in the first position or the second position based, at least in part, on the output signal. For instance, the control device(s) can store one or more reference signal(s) indicative of the input signal and/or the type of output signals expected to be received when the relay is in the first or second positions. The control device(s) can determine whether the relay is in the first position or the second position based, at least in part, on similarities between the output signal and the reference signal.

By way of example, a reference signal stored in the control device(s) can be indicative of the type of output signal expected when the relay is in the second position (e.g., associated with the drain pump assembly). The control device(s) can sample the output signal at periodic intervals to determine a number of analog to digital counts. In some implementations, an analog to digital count can arise when one or more characteristics (e.g., voltage amplitude, frequency, form) of the reference signal are the same as or similar to one or more characteristics (e.g., voltage amplitude, frequency, form) of the output signal. The control device(s) can compare the number of analog to digital counts to a count threshold. In the event that the output signal exceeds the count threshold (e.g., indicating a higher level of similarity between the reference signal and the output signal), the control device(s) can determine that the relay is in the second position.

The control device(s) can be configured to selectively provide power to the first and/or second motors based, at least in part, on the relay position. For example, when the control device(s) determine that the relay is in the second position, the control device(s) can determine that a reduced amount of power is needed to run the second motor associated with the drain pump assembly. Accordingly, the control device(s) can send one or more command signal(s) to one or more power source(s) to provide the reduced amount of power to the second circuit of the second motor.

The systems and methods according to example aspects of the present disclosure can more reliably provide power to the motors of an appliance. More particularly, the systems and methods can determine the position of a relay relative to a plurality of motors to help provide an appropriate amount of power to the appliance motors. In this way, the systems and methods according to example aspects of the present disclosure have a technical effect of reducing the potential failure of appliance motors, while increasing user safety.

FIG. 1 depicts a side partial cut-away view of an appliance 100 according to example embodiments of the present disclosure. In some implementations, the appliance 100 can be a washing appliance such as, for example, a dishwashing appliance. The appliance 100 can include a cabinet 102 having a tub 104 therein that defines a wash chamber 106. The tub 104 can have a door 120 hinged at its bottom 122 for movement between a normally closed vertical position (shown in FIG. 1) wherein the wash chamber 106 can be sealed shut for washing operation, and a horizontal open position for loading and unloading of articles from the wash chamber 106 of the appliance 100.

Upper and lower guide rails 124, 126 can be mounted on tub side walls 128 and accommodate upper and lower roller-equipped racks 130, 132, respectively. Each of the upper and lower racks 130, 132 can be fabricated into lattice structures including a plurality of elongate members 134, and each of the racks 130, 132 can be adapted for movement between an extended loading position (not shown) in which the racks 130, 132 can be substantially positioned outside the wash chamber 106, and a retracted position (shown in FIG. 1) in which the racks 130, 132 can be located inside the wash chamber 106.

The appliance 100 can further include a lower spray assembly 144 that can be mounted (e.g., rotatably) within a lower region 146 of the wash chamber 106 and above a tub sump portion 142 so as to rotate in relatively close proximity to the lower rack 132. A mid-level spray assembly 148 can be located in an upper region of the wash chamber 106 and can be located in close proximity to the upper rack 130. Additionally, an upper spray assembly (not shown) can be located above the upper rack 130.

The lower and mid-level spray assemblies 144, 148 and upper spray assembly can be fed by a fluid circulation assembly (not shown) for circulating water and dishwasher fluid in the tub 104. The fluid circulation assembly can be located in a machinery compartment 140 located below the bottom sump portion 142 of the tub 104. Each spray assembly can include an arrangement of discharge ports or orifices for directing washing fluid onto dishes or other articles located in the upper and lower racks 130, 132, respectively. In an example implementation, the arrangement of the discharge ports in at least the lower spray assembly 144 can provide a rotational force by virtue of washing fluid flowing through the discharge ports. The resultant rotation of the lower spray assembly 144 can provide coverage of dishes and other dishwasher contents with a washing spray.

The appliance 100 can be further equipped with a processing device or controller 137 to regulate operation of the appliance 100. The controller 137 can include a memory and microprocessor, such as a general or special purpose microprocessor operable to execute programming instructions or micro-control code associated with a cleaning cycle. The memory may represent random access memory such as DRAM, or read only memory such as ROM or FLASH. In one implementation, the processor can execute programming instructions stored in memory. The memory can be a separate component from the processor or can be included onboard within the processor.

The controller 137 can be positioned in a variety of locations throughout the appliance 100. As shown in FIG. 1, the controller 137 can be located within a control panel area of the door 120. In such an implementation, input/output ("I/O") signals can be routed between the control system and various operational components of the appliance 100 along wiring harnesses that can be routed through the bottom 122 of the door 120. Typically, the controller 137 can include a user interface panel 136 through which a user can select various operational features and modes and monitor progress of the appliance 100. In one implementation, the user interface 136 can represent a general purpose I/O ("GPIO") device or functional block. In implementation, the user interface 136 can include input components, such as one or more of a variety of electrical, mechanical or electromechanical input devices including rotary dials, push buttons, and touch pads. The user interface 136 can include a display component, such as a digital or analog display device designed to provide operational feedback to a user. The user interface 136 can be in communication with the controller 137 via one or more signal lines or shared communication busses.

It should be appreciated that the present disclosure is not limited to any particular type, style, model, or other configuration of appliance, and that the appliance 100 depicted in FIG. 1 is for illustrative purposes only. While the figures and description herein discuss the present disclosure with reference to a washing appliance (e.g., a dishwashing appliance), one of ordinary skill in the art will understand that the present disclosure is not limited to a washing appliance. For instance, aspects of the present disclosure can be implemented in any appliance with more than one motor.

Figure 2:
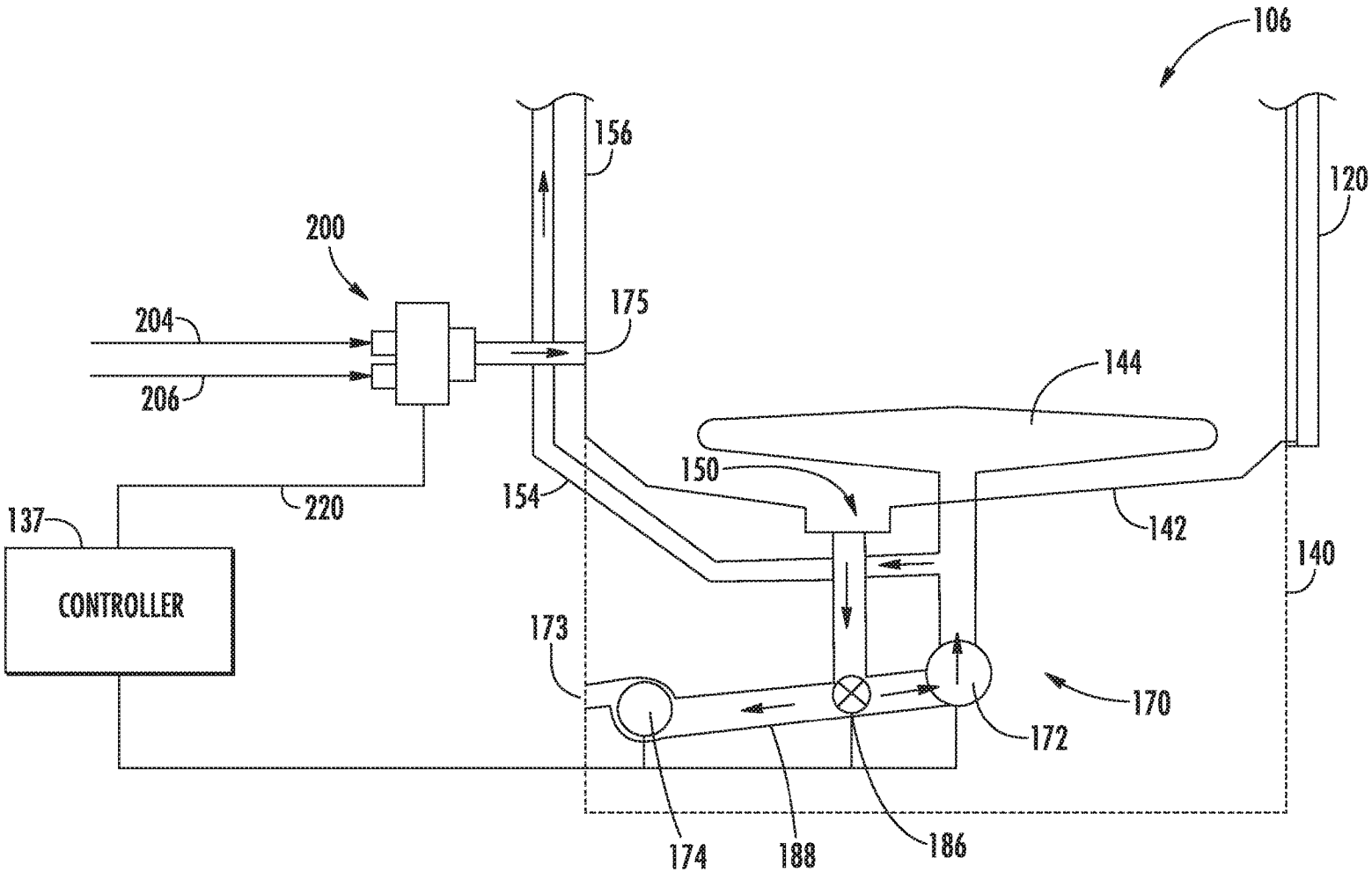
FIG. 2 depicts a schematic view of a fluid system of the appliance of FIG. 1.

FIG. 2 depicts a schematic view of a fluid system of the appliance 100. As shown in FIG. 2, the appliance 100 can include a fluid circulation assembly 170 disposed below the wash chamber 106. Although one implementation of the fluid circulation assembly 170 that is operable to perform in accordance with aspects of the present disclosure is shown, it is contemplated that other fluid circulation assembly configurations can similarly be utilized without departing from the spirit and scope of the present disclosure.

The fluid circulation assembly 170 can include a circulation wash pump assembly 172 and a drain pump assembly 174, both in fluid communication with the sump 150. Additionally, the drain pump assembly 174 can be in fluid communication with an external drain 173 to discharge used wash liquid, e.g., to a sewer or septic system (not shown). Further, the circulation wash pump assembly 172 can be in fluid communication with the lower spray arm assembly 144 and a conduit 154 which extends to a back wall 156 of the wash chamber 106, and upward along the back wall 156 for feeding wash liquid to the mid-level spray arm assembly 148 (FIG. 1) and the upper spray arm assembly.

As wash liquid is pumped through the lower spray arm assembly 144, and further delivered to the mid-level spray arm assembly 148 and the upper spray arm assembly (not shown), washing sprays can be generated in the wash chamber 106, and wash liquid can collect in the sump 150. The sump 150 can include a cover to prevent larger objects from entering the sump 150, such as an item that is dropped beneath the lower rack 132. A coarse filter and a fine filter (not shown) can be located adjacent to the sump 150 to filter wash liquid for sediment and particles of predetermined sizes before flowing into the sump 150.

A turbidity sensor (not shown) can be coupled to the sump 150 and used to sense a level of sediment in the sump 150 and to initiate a sump purge cycle where the contents or a fractional volume of the contents of the sump 150 can be discharged when a turbidity level in the sump 150 approaches a predetermined threshold. The sump 150 can be filled with water through an inlet port 175 which outlets into the wash chamber 106.

A water supply 200 can be configured with the inlet port 175 for supplying wash liquid to the wash chamber 106. The water supply 200 can provide hot water only, cold water only, or either selectively as desired. As depicted, the water supply 200 can include a hot water inlet 204 that can receive hot water from an external source, such as a hot water heater and a cold water input 206 that can receive cold water from an external source. It should be understood that the term "water supply" is used herein to encompass any manner or combination of valves, lines or tubing, housing, and the like, and may simply comprise a conventional hot or cold water connection.

As shown in FIG. 2, a drain valve 186 can be established in flow communication with the sump 150 and can open or close flow communication between the sump 150 and a drain pump inlet 188. The drain pump assembly 174 can be in flow communication with the drain pump inlet 188 and can include an electric motor for pumping fluid at the inlet 188 to an external drain system via the drain 173. In one implementation, when the drain pump assembly 174 is energized, a negative pressure can be created in the drain pump inlet 188 and the drain valve 186 can be opened, allowing fluid in the sump 150 to flow into the fluid pump inlet 188 and be discharged from the fluid circulation assembly 170 via the external drain 173.

Additionally and/or alternatively, the drain and recirculation pump assemblies 172 and 174 can be connected directly to the side or the bottom of the sump 150, and the drain and the pump assemblies 172, 174 can each include their own valving replacing the drain valve 186. Other fluid circulation systems are possible as well, drawing fluid from the sump 150 and providing fluid as desired within the wash chamber 106 or draining fluid out of the appliance 100.

Figure 3:
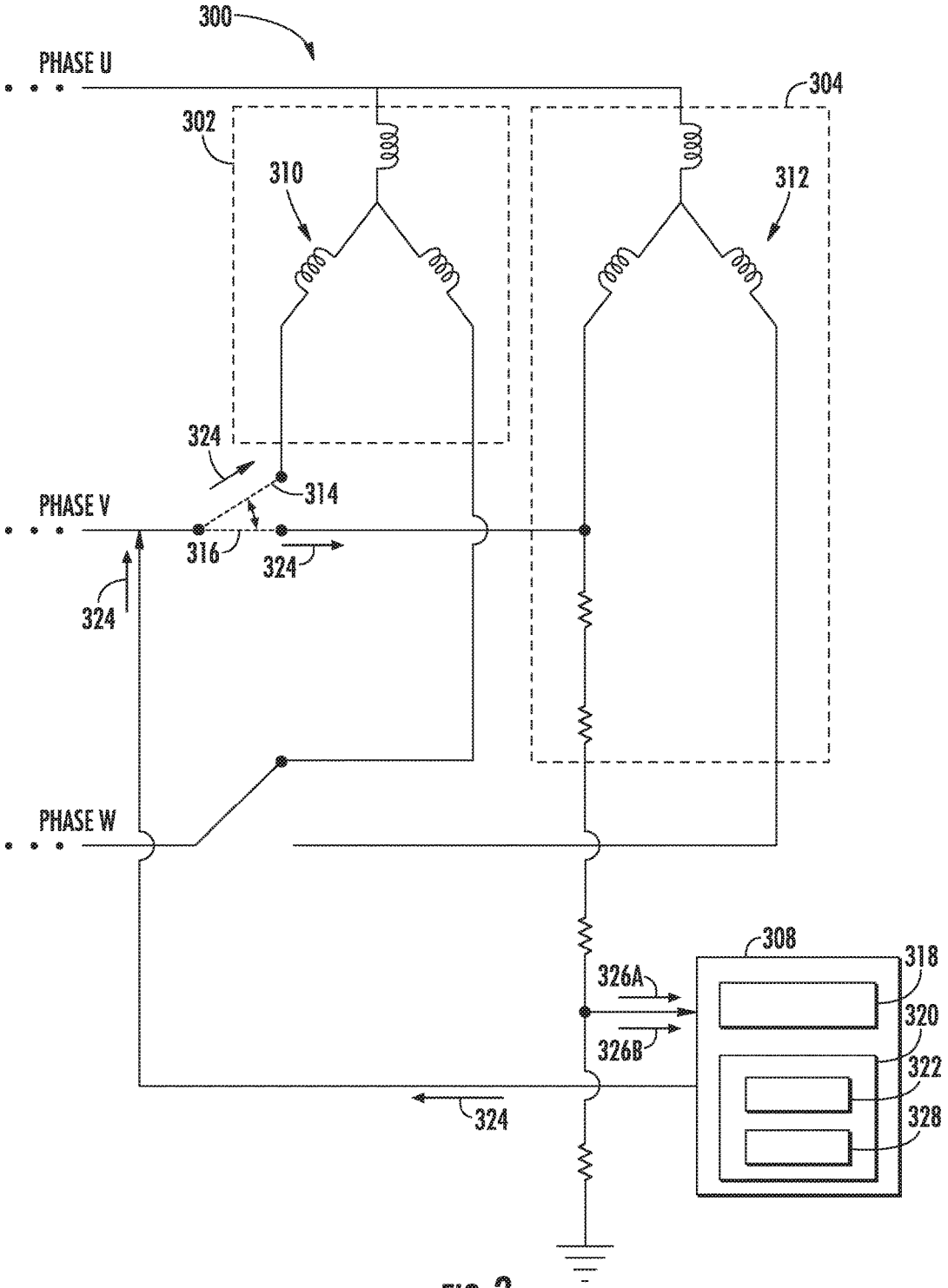
FIG. 3 depicts an example system for identifying relay contact position according to example embodiments of the present disclosure.

FIG. 3 depicts an example system 300 for identifying relay contact position according to example embodiments of the present disclosure. The system 300 can be implemented in an appliance, such as the appliance 100 described with reference to FIGS. 1 and 2. The appliance 100 can include a first motor 302, a second motor 304, a relay 306, and one or more control device(s) 308. The first motor 302, the second motor 304, the relay 306, and the control device(s) 308 can be in wired communication with one another. In some implementations, the components can also be in wireless communication. The number and types of components shown in FIG. 3 are not intended to be limiting. Those of ordinary skill in the art, using the disclosure provided herein, will understand that the system 300 can include difference types, numbers, and/or configurations of components than shown. For example, the system 300 can include more than two motors and more than one relay.

In some implementations, the first motor 302 can be associated with the circulation wash pump assembly 172. For instance, the first motor 302 can be configured to drive the pumping mechanism of the circulation wash pump assembly 172. As shown, a first circuit 310 can be associated with the first motor 302. The first circuit 312 can include a variety of electrical components. For instance, the first circuit 310 can include one or more inductors, as shown in FIG. 3.

In some implementations, the second motor 304 can be associated with the drain pump assembly 174. For instance, the second motor 304 can be configured to drive the pumping mechanism of the drain pump assembly 174. A second circuit 312 can be associated with the second motor 304. The second circuit 312 can include a variety of electrical components. For instance, the second circuit 312 can include one or more inductors and one or more resistors, as shown in FIG. 3.

The relay 306 can be configured to be adjustable between a plurality of positions. For example, the relay 306 can be configured to be adjusted between at least a first position 314 associated with the first circuit 310 of the first motor 302 and a second position 316 associated with the second circuit 312 of the second motor 304. When the relay 306 is in the first position 314, power can be provided to at least the first circuit 310 to run the first motor 302. When the relay 306 is in the second position 316, power can be provided to at least the second circuit 312 to run the second motor 304. The power required to run the first motor 302 (e.g., associated with the circulation wash pump assembly 172) can be greater than the power required to run the second motor 304 (e.g., associated with the drain pump assembly 174).

The one or more control device(s) 308 of appliance 100 can include a number of components. For instance, the control device(s) 308 can include one or more processor(s) 318 and one or more memory device(s) 320. The one or more memory device(s) 320 can store instructions 322 that when executed by the one or more processor(s) 318 cause the one or more processor(s) 318 to perform operations and functions that the control device(s) are configured to perform, as described herein with reference to FIGS. 3-5. In some implementations, the control device(s) 308 can be included and/or associated with the controller 137. In other implementations, the control device(s) 308 can be separate from the controller 137.

The control device(s) 308 can be configured to perform operations to identify the position of the relay 306 within the appliance 100. For example, the control device(s) 308 can be configured to provide a test signal 324 to the relay 306. In some implementations, the test signal 324 can include one or more pulses and/or can include a test voltage (e.g., 170 V).

The control device(s) 308 can be configured to detect an output signal via one or more sensing devices (not shown). The output signal can be based, at least in part, on the test signal 324 and/or can be associated with the second circuit 312. For example, as shown in FIG. 3, when the relay 306 is in the first position 314 the test signal 324 can be applied to the electrical components of the first circuit 310 and the electrical components of the second circuit 312 to produce a first output signal 326A. However, when the relay 306 is in the second position 314 the test signal 324 can be applied to the electrical components of the second circuit 312 associated with the second motor 304 to produce a second output signal 326B. Given the different electrical paths of the test signal 324 when the relay 306 is in the first position 314 or second position 316, the first output signal 326A can be different than the second output signal 326B.

Figure 4:
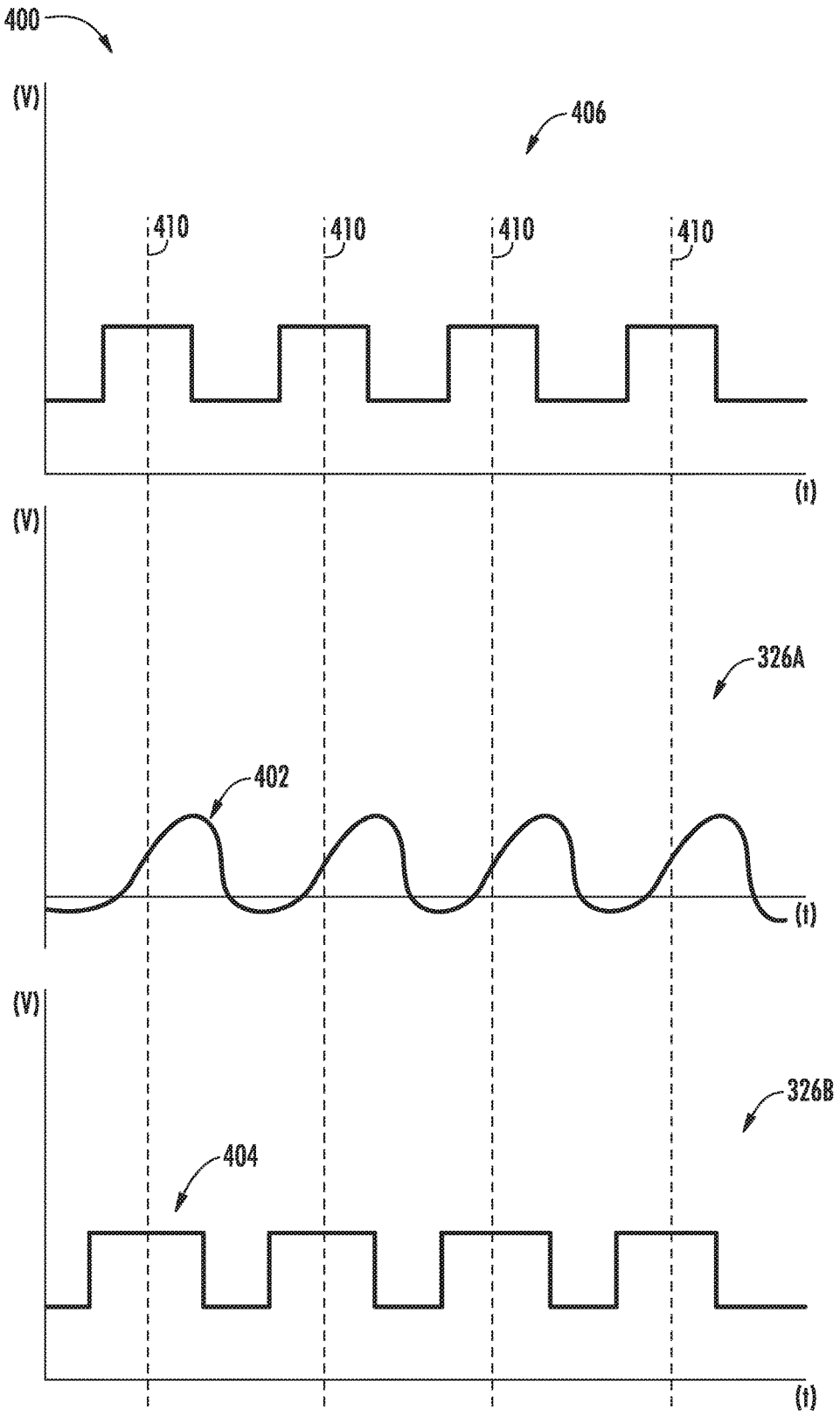
FIG. 4 depicts example phase diagrams according to example embodiments of the present disclosure.

For example, FIG. 4 depicts example phase diagrams 400 according to example embodiments of the present disclosure. As shown in FIG. 4, in some implementations, the first output signal 326A (e.g., associated with the relay 306 being in the first position 314) can be associated with a sinusoidal wave form, while the second output signal 326B (e.g., associated with the relay 306 being in the second position 316) can be associated with a square wave form. The first output signal 326A can be indicative of a first output voltage 402 and the second output signal 326B can be indicative of the second output voltage 404. The first output voltage 402 can be different than a second output voltage 404. In some implementations, the first output voltage 402 (e.g., 0.2V) can be orders of magnitude less than the second output voltage 404 (e.g., 3.0V).

The control device(s) 308 can be configured to store one or more reference signal(s) 406 in the memory device(s) 320 (e.g., as data 328). In some implementations, the reference signal(s) 406 can be the same as or similar to the test signal 324. Additionally, and/or alternatively, the reference signal(s) 406 can be indicative of the type of output signal expected to be received when the relay 306 is in the first or second positions 314, 316. The control device(s) 308 can be configured to determine whether the relay 306 is in the first position 314 or the second position 316 based, at least in part, on the similarities between the output signals 326A-B and the reference signal 406.

The control device(s) 308 can be configured to determine whether the relay 306 is in the first position 314 or the second position 316 based, at least in part, on a leading edge of a pulse detected in the first or second output signals 326A, 326B. For example, the control device(s) 308 can be configured to sample the output signals 326A, 326B at periodic intervals 410 to determine a number of analog to digital counts. In some implementations, an analog to digital count can arise when one or more characteristics (e.g., voltage amplitude, frequency, form) of the reference signal 406 are the same as or similar to one or more characteristics of the output signals 326A, 326B. As shown in FIG. 4, the characteristics of the reference signal 406 are at least similar to the characteristics of the output signal 326B for the periodic intervals 410 shown. This can result in an analog to digital count at each periodic interval 410. However, for at least the periodic intervals 410 shown in FIG. 4, the characteristics of the reference signal 406 do not appear to be similar to the characteristics of the output signal 326A.

The control device(s) 308 can be configured to determine whether the relay 306 is in the first position 314 or the second position 316 based, at least in part, on the number of analog to digital counts. For instance, the control device(s) 308 can be configured to the compare the number of analog to digital counts to a count threshold (e.g., 1000, 2000, 3000 counts). The count threshold can, for example, be stored in the data 328 of the memory device(s) 320. The control device(s) 308 can be configured to determine whether the relay 306 is in the first position 314 or the second position 316 based, at least in part, on whether the number of analog to digital counts exceeds the count threshold. For example, the number of analog to digital counts of the first output signal 326A can be 200 counts, failing to exceed the count threshold. Thus, in the event that the control device(s) 308 receive the first output signal 326A, the control device(s) 308 can determine that the relay 306 is in the first position 314 for at least the reason that the number of analog to digital counts did not exceed the count threshold (e.g., indicating dissimilarity with the reference signal 406).

In another example, the number of analog to digital counts associated with the second output signal 326B can be 3000 counts, exceeding the count threshold. Accordingly, in the event that the control device(s) 308 receive the second output signal 326B, the control device(s) 308 can determine that the relay 306 is in the second position 316 based, at least in part, on the number of analog to digital counts associated with the output signal 326B exceeding the count threshold (e.g., indicating similarity with reference signal 406).

The control device(s) 308 can be configured to selectively provide power to the first and/or second motors 302, 304. For example, when the relay 306 is in the second position 316, the control device(s) 308 can be configured to send one or more command signals to one or more power sources to provide power to the second circuit 312 to run the second motor 304. However, when the relay 306 is in the first position 314, the control device(s) 308 can be configured to send one or more command signals to one or more power sources to provide power to the first circuit 310 to run the first motor 302. As described above, given the power requirement of the circulation wash pump assembly 172 and the drain pump assembly 174, the amount of power provided to the first circuit 310 can be greater than the amount of power provided to the second circuit 312.

Figure 5:
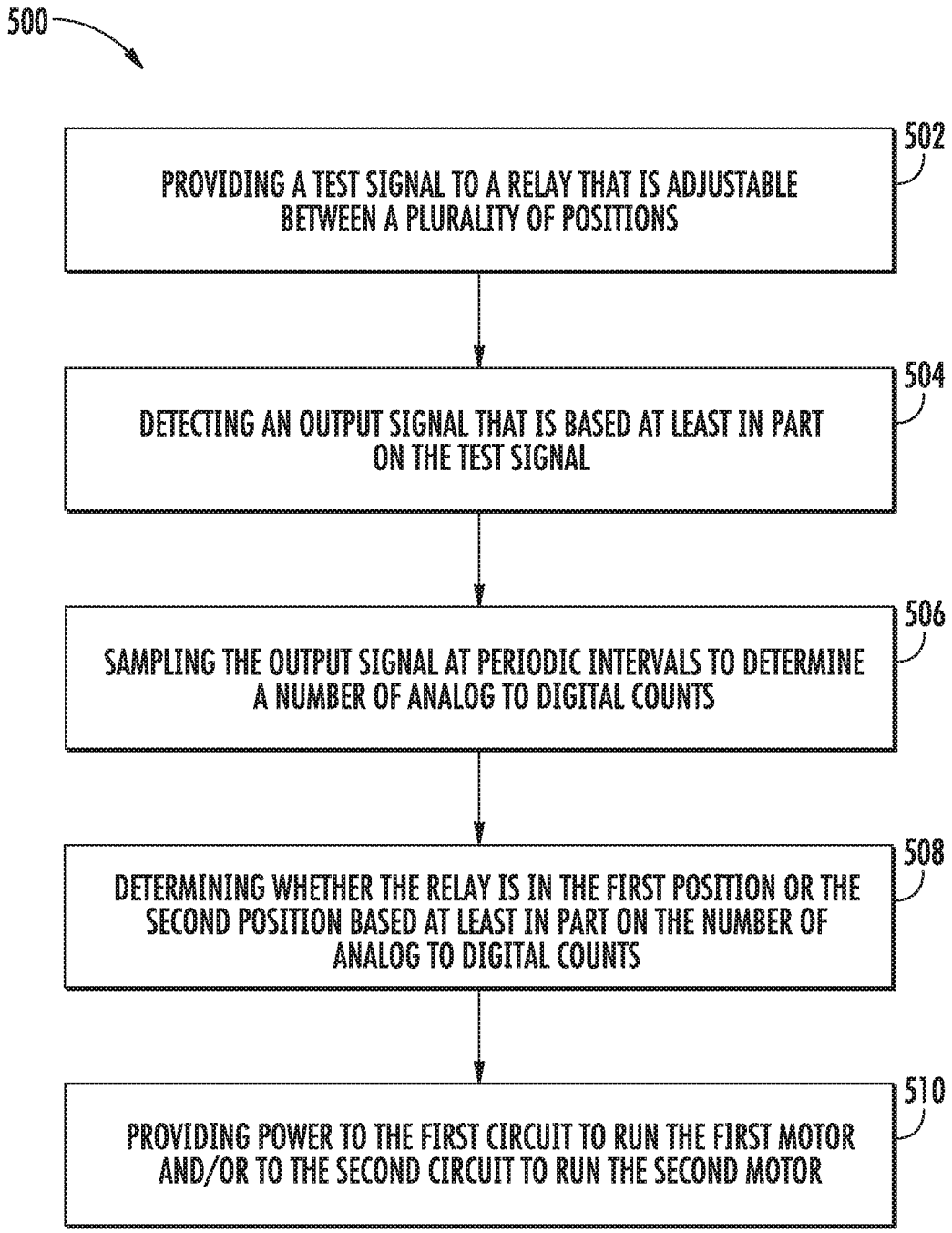
FIG. 5 depicts an example method of identifying relay contact position according to example embodiments of the present disclosure.

FIG. 5 depicts an example method 500 of identifying relay contact position according to example embodiments of the present disclosure. The method 500 can be implemented in an appliance, such as a washing appliance as described herein. FIG. 5 can be implemented by one or more computing device(s), such as the computing device(s) 308 depicted in FIG. 3. In addition, FIG. 5 depicts steps performed in a particular order for purposes of illustration and discussion. Those of ordinary skill in the art, using the disclosures provided herein, will understand that the various steps of any of the methods disclosed herein can be modified, adapted, expanded, rearranged and/or omitted in various ways without deviating from the scope of the present disclosure.

At (502), the method 500 can include providing a test signal to a relay that is adjustable between a plurality of positions. For instance, the control device(s) 308 can provide a test signal 324 to the relay 306. As indicated above, the relay 306 can be adjustable between a plurality of positions. The plurality of positions can include the first position 314 associated with the first circuit 310 of the first motor 302 (e.g., associated with the circulation wash pump assembly 172) and the second position 316 associated with the second circuit 312 of the second motor 304 (e.g., associated with the drain pump assembly 174). As indicated above, the test signal 324 can include one or more pulses and can be indicative of a test voltage.

At (504), the method 500 can include detecting an output signal that is based, at least in part, on the test signal. For instance, the control device(s) 308 can detect an output signal 326A-B that is based, at least in part, on the test signal 324. As indicated above, in the event that the test signal 324 is applied to the electrical components of the first circuit 310 and the second circuit 312, the control device(s) 308 can detect the first output signal 326A. However, in the event that the test signal 324 is only applied to the electrical components of the second circuit 312, the control device(s) 308 can detect the second output signal 326B.

At (506), the method 500 can include sampling the output signal at periodic intervals to determine a number of analog to digital counts. For instance, the control device(s) 308 can sample the first output signal 326A and/or the second output signal 326B at periodic intervals 410. The control device(s) 308 can determine the number of analog to digital counts for each output signal 326A, 326B, as described above.

At (508), the method 500 can include determining whether the relay is in the first position or the second position based, at least in part, on the number of analog to digital counts. For instance, the control device(s) 308 can be configured to determine whether the relay 306 is in the first position 314 or the second position 316 based, at least in part, on the number of analog to digital counts associated with an output signal 326A-B. The control device(s) 308 can determine whether the relay 306 is in the first position 314 or the second position 316 based, at least in part, on a leading edge of a pulse detected in the first and/or second output signals 326A-B. In some implementations, the control device(s) 308 can use the detected pulses to compare the first and/or second output signals 326A-B to the reference signal 406. The control device(s) 308 can determine whether the relay 306 is in the first position 314 or the second position 316 based on similarities between the pulses of the output signal 326A-B (e.g., output frequency, output voltage) and the reference signal 406.

At (510), the method 500 can include providing power to the first circuit to run the first motor and/or to the second circuit to run the second motor. For instance, the position of the relay 306 can be indicative of whether at least one of the first circuit 310 or the second circuit 312 is configured to receive power. When the relay 306 is in the first position 314, at least the first circuit 310 can receive power and when the relay 306 is in the second position 316, at least the second circuit 312 can receive power. Thus, after determining the position of the relay 306, the control device(s) 308 can provide power (e.g., via command signals to power sources) to the first circuit 310 to run the first motor 302 and/or provide power to the second circuit 312 to run the second motor 304. In this way, the control device(s) 308 can determine the amount of power to provide to the first circuit 310 and/or second circuit 312 by first determining the position of relay 306, which can be indicative of the amount of power that should be provided to the relay 306 and ultimately the first or second circuits 310, 312. This can help avoid overheating the second motor 304 (e.g., associated with the drain pump assembly 174) which requires less power than the first motor 302.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing appliance, the appliance comprising:

a cabinet defining a wash chamber for receipt of articles for washing;

a spray arm disposed within the wash chamber;

a first motor associated with a circulation wash pump assembly of the washing appliance;

a second motor associated with a drain pump assembly of the washing appliance;

a relay configured to be adjusted between at least a first position associated with a first circuit of the first motor and a second position associated with a second circuit of the second motor; and one or more control devices configured to identify the position of the relay within the appliance by executing computer-readable instructions stored in one or more memory devices that when executed by the one or more control devices cause the one or more control devices to perform operations, the operations comprising:

providing a test signal to the relay;

detecting an output signal that is based on the test signal, wherein the output signal is associated with the second circuit;

determining the relay is in the first position when the output signal corresponds to a first reference signal indicative of the relay being in the first position; and determining the relay is in the second position when the output signal corresponds to a second reference signal indicative of the relay being in the second position.

2. The washing appliance of claim 1, wherein the test signal comprises one or more pulses.

3. The washing appliance of claim 1, wherein the output signal corresponds to the first reference sign when a leading edge of a pulse detected in the output signal corresponds to a leading edge of a pulse associated with the first reference signal, and wherein the output signal corresponds to the second reference signal when the leading edge of the pulse detected in the output signal corresponds to a leading edge of a pulse associated with the second reference signal.

4. The washing appliance of claim 1, further comprising:

sampling the output signal at periodic intervals to determine a number of analog to digital counts.

5. The washing appliance of claim 4, further comprising:

comparing the number of analog to digital counts to a count threshold;

determining the relay is in the first position when the number of analog to digital counts is below the count threshold; and determining the relay is in the second position when the number of analog to digital counts is greater than the count threshold.

6. The washing appliance of claim 1, wherein the output signal corresponds to the first reference signal when a voltage associated with the output signal corresponds to a voltage associated with the first reference signal, and wherein the output signal corresponds to the second reference signal when the voltage associated with the output signal corresponds to a voltage associated with the second reference signal.

7. The washing appliance of claim 1, wherein when the relay is in the first position, the operations further comprise:

providing power to the first circuit to run the first motor.

8. The washing appliance of claim 1, wherein when the relay position is in the second position, the operations further comprise:

providing power to the second circuit to run the second motor.

9. The washing appliance of claim 1, wherein the appliance is a dishwashing appliance.

* * * * *